US006209463B1

(12) United States Patent
Koharchik et al.

(10) Patent No.: US 6,209,463 B1
(45) Date of Patent: Apr. 3, 2001

(54) MEDICAL EXAMINATION TABLE

(75) Inventors: Louis T. Koharchik; Michael A. Pribish; Jacob D. Radwanski; Mark J. Romano, all of Johnstown, PA (US)

(73) Assignee: United Metal Fabricators, Inc., Johnstown, PA (US)

( * ) Notice: Subject to any disclaimer, the term of this patent is extended or adjusted under 35 U.S.C. 154(b) by 0 days.

(21) Appl. No.: 09/267,871

(22) Filed: Mar. 12, 1999

(51) Int. Cl.[7] ..... A47F 5/12
(52) U.S. Cl. ..... 108/7; 5/617
(58) Field of Search ..... 100/7, 3, 1; 297/377; 5/617, 610, 608, 607, 613, 624

(56) References Cited

U.S. PATENT DOCUMENTS 2,639,541 * 5/1953 Le Tang ..... 108/7
3,334,951 * 8/1967 Douglass, Jr. et al. .
3,413,663 * 12/1968 Swann .
4,222,131 * 9/1980 Holdt et al. ..... 5/617
4,397,245 * 8/1983 Washburn ..... 108/7
4,529,185 * 7/1985 Gutierres .
4,535,492 * 8/1985 Sebest ..... 5/617 X
4,584,989 * 4/1986 Stith .
4,968,013 * 11/1990 Kuck .
5,329,657 * 7/1994 Bartley et al. .
5,678,263 10/1997 Berthe .
5,829,077 * 11/1998 Niege ..... 5/617 X

FOREIGN PATENT DOCUMENTS

2580915 * 10/1986 (FR) ..... 5/610

* cited by examiner

*Primary Examiner*—Jose V. Chen
(74) *Attorney, Agent, or Firm*—Kirkpatrick & Lockhart LLP

(57) ABSTRACT

A medical examination table having an apparatus for support and securing the backrest to an inclined position, self-adjusting drawers having a resilient extension fixedly connected to at least one of two side panels of the drawer, wherein the drawer is slideably connectable within multiple sized drawer openings, a retractable footstep having a platform slideably received within a cavity of the table and able to be locked in an extended position and a retractable leg rest having a shelf member slideably received within another cavity of the table and having a lip and a pad for continuously supporting the patient's leg.

21 Claims, 14 Drawing Sheets

MEDICAL EXAMINATION TABLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a medical examination table. More particularly, the present invention is directed to a medical examination table having an adjustable backrest, at least one self-adjusting drawer, a retractable footstep and a retractable leg rest.

2. Description of the Background

Many conventional medical examination tables have a backrest portion that is movable from a horizontal position to an inclined position. Typically, the backrest portion is supported by the top surface of the medical examination table when the backrest portion is in the horizontal position. When the backrest portion is in the inclined position, a rod that is pivotally connected to the backrest portion supports the backrest portion. Generally, the rod extends between the back surface of the backrest portion and the top surface of the examination table and further extends through a hole defined by a flag member. The flag member is fixedly mounted on a shaft that transverses and is rotatably mounted on the top surface of the medical table. By angling the flag member, the edges of the flag member that define the hole frictionally engage the rod passing therethrough and hold the rod in the inclined position. To move the backrest portion from the inclined position to the horizontal position, a knob mounted on the exterior surface of the medical table is rotated thereby rotating the shaft until the flag member disengages the rod.

One disadvantage of this type of medical examination table is that someone walking past the table could accidentally contact the knob resulting in the flag member being disengaged from the rod and the backrest moving from the inclined position to the horizontal position while a patient is on the examination table.

Additionally, existing medical examination tables usually have multiple drawers therein which hold medical paraphernalia such as bandages, blood pressure cuffs, etc. Typically, the drawer sizes are not standard thus, each drawer must be custom manufactured to fit within a specific drawer opening in the medical examination table. Furthermore, the drawers must be manufactured with very small tolerance because if the drawer does not fit within the opening, the material and time to make the drawer will be wasted. The disadvantage to this type of medical examination table is that the custom manufactured drawers are expensive to manufacture and can only be used in a specific drawer opening.

Some conventional medical examination tables also have retractable footstools that patients step on in order to lift themselves onto the examination table. Once the patient is lying on the table, the footstool can be retracted into the table thereby increasing the amount of floor space in the examination room and eliminating an obstruction that prevents the doctor or nurse from easily accessing the patient. The disadvantage with existing retractable footstools is that they cannot lock into their extended position while still having sufficient strength to support large patients weighing up to four hundred pounds.

Conventional medical examination tables also typically provide a support for the patient's legs. The support can take many forms such as a retractable shelf having a pad thereon. Many of these supports are uncomfortable to the patients in that the supports is not contiguous with the seat portion of the examination table resulting in the patient's legs not being solidly supported. Also, prior leg extension support may not be angularly adjustable.

Accordingly, there is a need for a medical examination table that has a support apparatus for the backrest which has a lock mechanism that positively holds the backrest in place and minimizes the chance of the backrest inadvertently moving from the inclined position to the horizontal position, especially while a patient is on the table.

The need also exists for a medical examination table having self adjusting drawers that can be used in multiple-size drawer openings thereby eliminating the need to custom manufacture each drawer for a single drawer opening and also eliminating the need to custom manufacture the drawer and drawer opening of the medical examination table to very small tolerances.

Yet another need exists for a medical examination table having a retractable footstep that is strong yet lockable in an extended position.

Still another need exists for a medical examination table having a leg rest that continuously and comfortably supports the legs of a patient sitting or lying on the medical examination table.

BRIEF SUMMARY OF THE INVENTION

The present invention provides a device for supporting a structure, such as the backrest of a medical examination table, from a horizontal position to an inclined position, wherein the support device includes an arm that supports the structure and that pivots from a horizontal position to an inclined position and a lock mechanism that prevents movement of the arm while in the locked position.

The present invention further provides a self-aligning drawer for a structure having a frame with two connected side panels and a resilient extension fixedly connected to each of the side panels, wherein the resilient extensions deform such that the drawer can fit within a variety of sized structure openings.

The present invention further provides a retractable footstep for a medical examination table including a runner fixedly attached to a cavity of the table and having slots, a platform slideably received within the runner and having a plurality of tabs that engage the slots preventing the platform from separating from the runner and a latch connected to the platform that limits the length of the platform extending from the examination table.

The present invention provides a retractable leg rest for a medical examination table including a shelf member slideably received within a cavity of the table and having a lip portion and a pad, wherein the lip portion prevents the pad from sliding off the shelf and the pad can be inclined such that the patient's legs are solidly supported.

The present invention further provides a medical examination table having an apparatus for supporting and securing the backrest in an inclined position, self-adjusting drawers that can fit within multiple sized drawer openings, a retractable footstep having a platform able to lock in an extended position, and a retractable leg rest having a shelf member with a lip and a pad for solidly supporting the patient's legs.

Other details, objects and advantages of the present invention will become more apparent from the following description of the present invention.

BRIEF DESCRIPTION OF THE SEVERAL VIEWS OF THE DRAWINGS

For the present invention to be understood and readily practiced, the present invention will be described in conjunction with the following Figures wherein.

DETAILED DESCRIPTION OF THE INVENTION

The present invention will be described below in terms of a medical examination table. It should be noted that describing the present invention in terms of a medical examination table is for illustrative purposes and the advantages of the present invention may be realized using other structures and technologies that have a need for a support apparatus that securely supports a structure in an inclined position, a self-aligning drawer that fits within multiple-sized drawer openings, a retractable leg rest that solidly supports a person's legs or a retractable footstep that can support large loads and be locked into an extended position.

It is to be further understood that the Figures and descriptions of the present invention have been simplified to illustrate elements that are relevant for a clear understanding of the present invention while eliminating, for purposes of clarity, other elements and/or descriptions thereof found in a typical medical examination table. Those of ordinary skill in the art will recognize that other elements may be desirable in order to implement the present invention. However, because such elements are well known in the art, and because they do not facilitate a better understanding of the present invention, a discussion of such elements is not provided herein.

Figure 2:
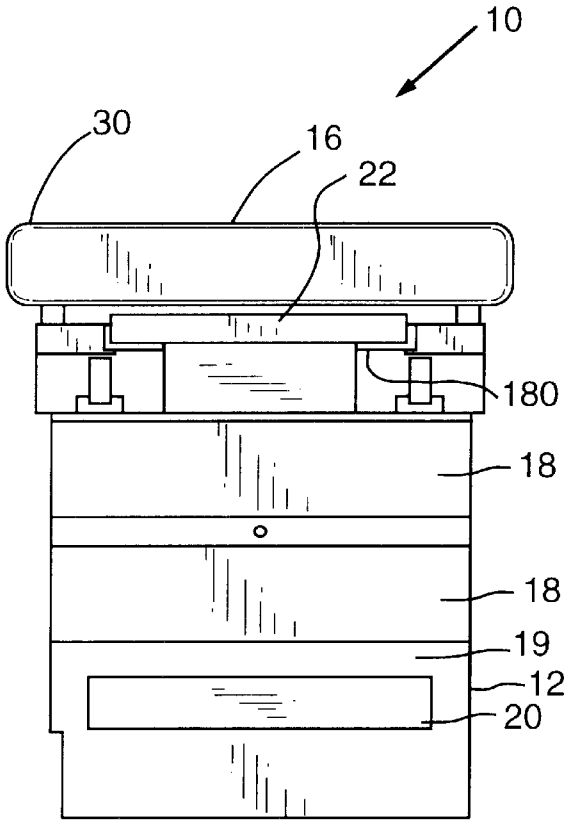
FIG. 2 is a front elevation view of the medical examination table of the present invention shown in FIG. 1.
Figure 1:
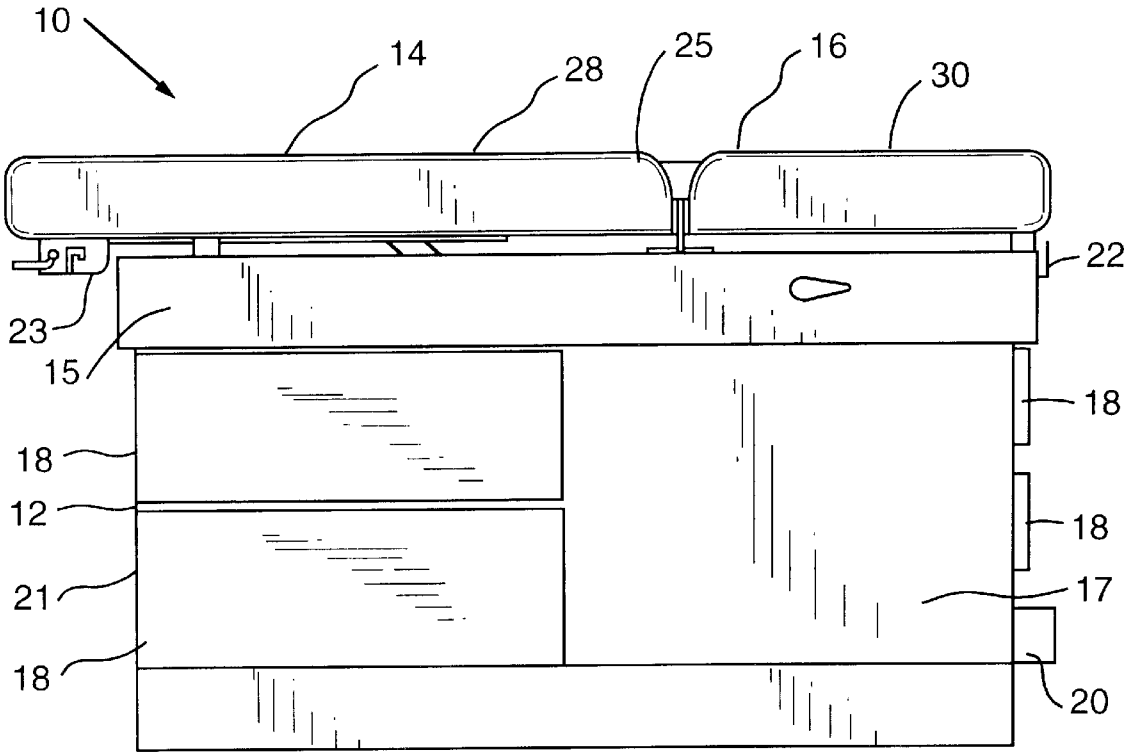
FIG. 1 is a side elevation view of a medical examination table of the present invention.
Figure 3:
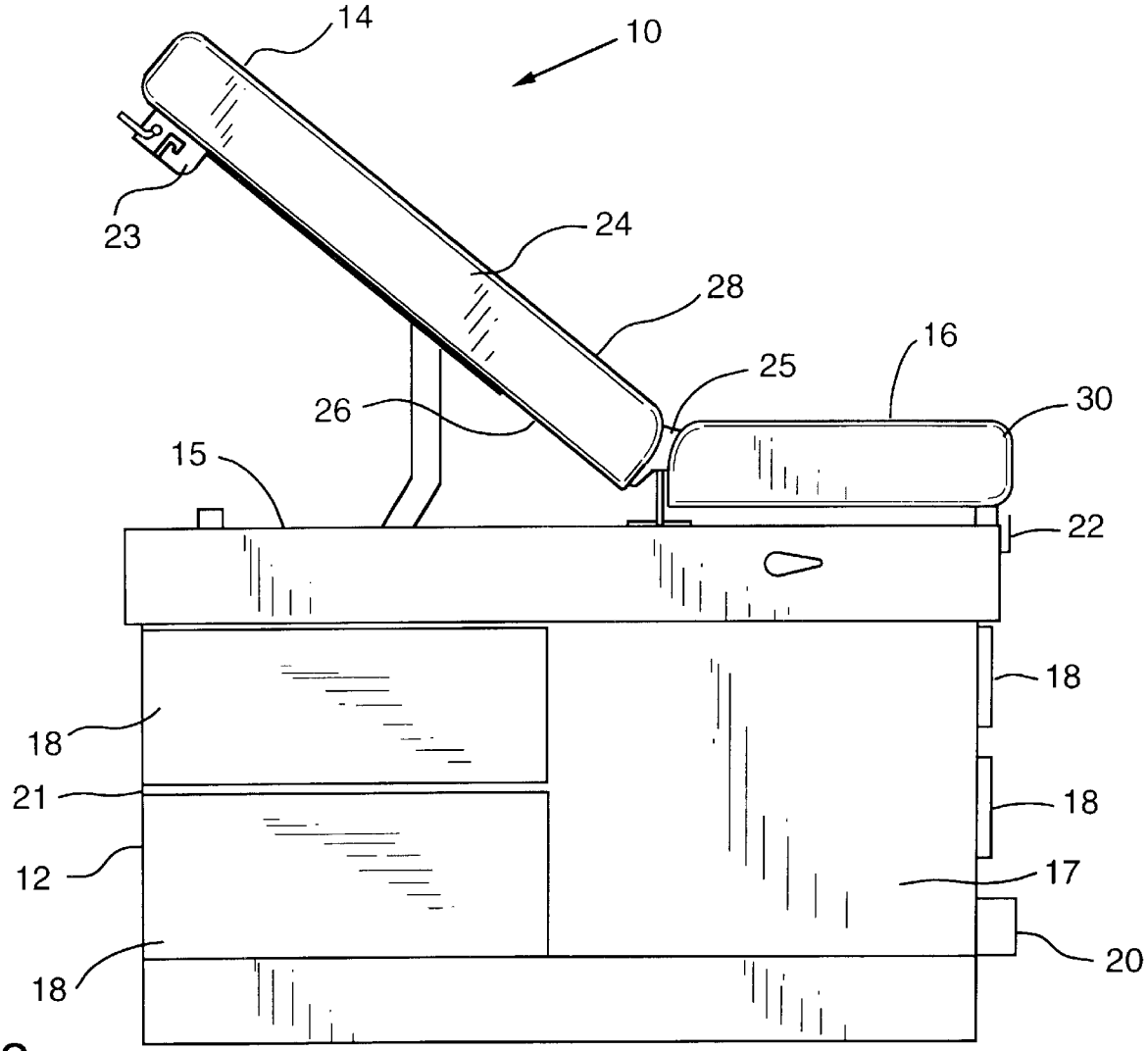
FIG. 3 is a side elevation view of the medical examination table shown in FIG. 1 with the backrest in the inclined position.
Figure 4:
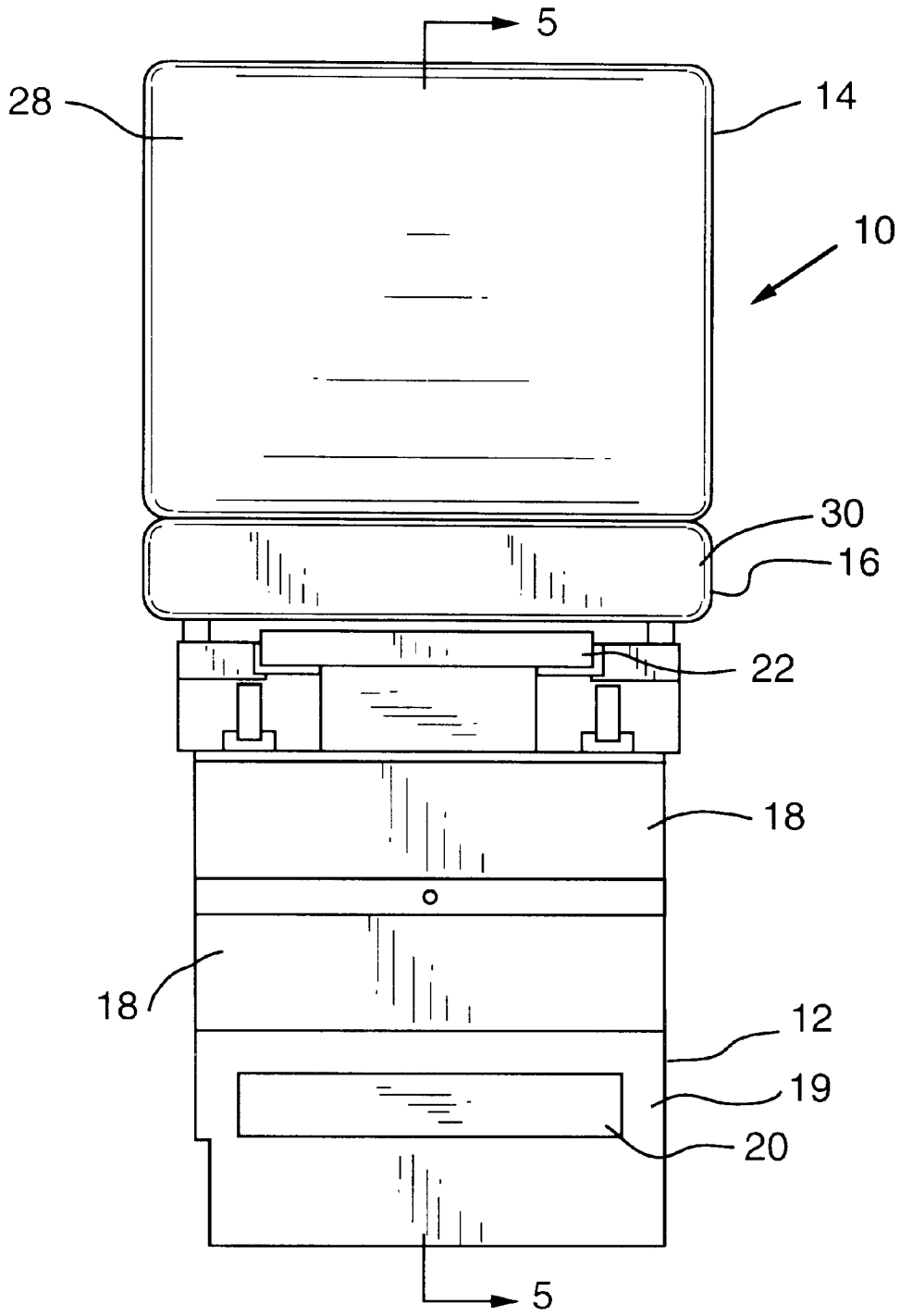
FIG. 4 is a front elevation view of the medical examination table shown in FIG. 1 with the backrest in the inclined position.

FIGS. 1 through 4 illustrate a medical examination table 10 of the present invention. The medical examination table 10 has a cabinet 12, a backrest 14 and a seat portion 16. FIGS. 1 and 2 illustrate the medical examination table 10 with the backrest 14 in a horizontal position and FIGS. 3 and 4 illustrate the medical examination table 10 with the backrest 14 in an inclined position.

The cabinet 12 has a top portion 15, two side surfaces 17, a front surface 19 and a back surface 21 which form a rectangular box structure. The cabinet 12 also has multiple drawers 18, a retractable footstep 20 and a retractable leg rest 22. Multiple drawers 18 are mounted on side surface 17 and the front surface 19. The retractable footstep 20 and the retractable leg rest 22 are mounted on the front surface 19. The cabinet 12 is manufactured form annealed steel with the top portion 15 being 18 gage annealed steel and the remaining portions of the cabinet 12 being 20 gage annealed steel. However, a person of ordinary skill will appreciate that many other materials can be used to manufacture the cabinet. For example, virtually any metal or composite may be used.

The backrest 14 has an upholstered top portion 24 and a bottom surface 26 and is pivotably connected to the top portion 15 of the cabinet 12 at 25 by a plurality of hinges (not shown). A padding (not shown) such as foam is covered with a water resistant material 28 such as vinyl to form the backrest top portion 24. The backrest top portion 24 is fixedly connected to the bottom wooden surface 26 by any type of fastener such as adhesive or screws. The medical examination table 10 may also have mounting brackets 23 fixedly connected to the back surface 26 for holding a roll of paper (not shown) such that a clean sheet of paper is placed on the backrest 14 and seat portion 16 for each new patient.

The seat portion 16 has an upholstered top portion 30 and a bottom surface (not shown). The seat portion 16 is also pivotally attached to the top portion 15 of the cabinet 12 at 25 by a plurality of hinges (not shown). Like the backrest top portion 24, the top portion 30 of the seat portion 16 includes padding (not shown) covered with a water resistant material 32 which is fixedly connected to the bottom surface of the seat portion 16.

Figure 5:
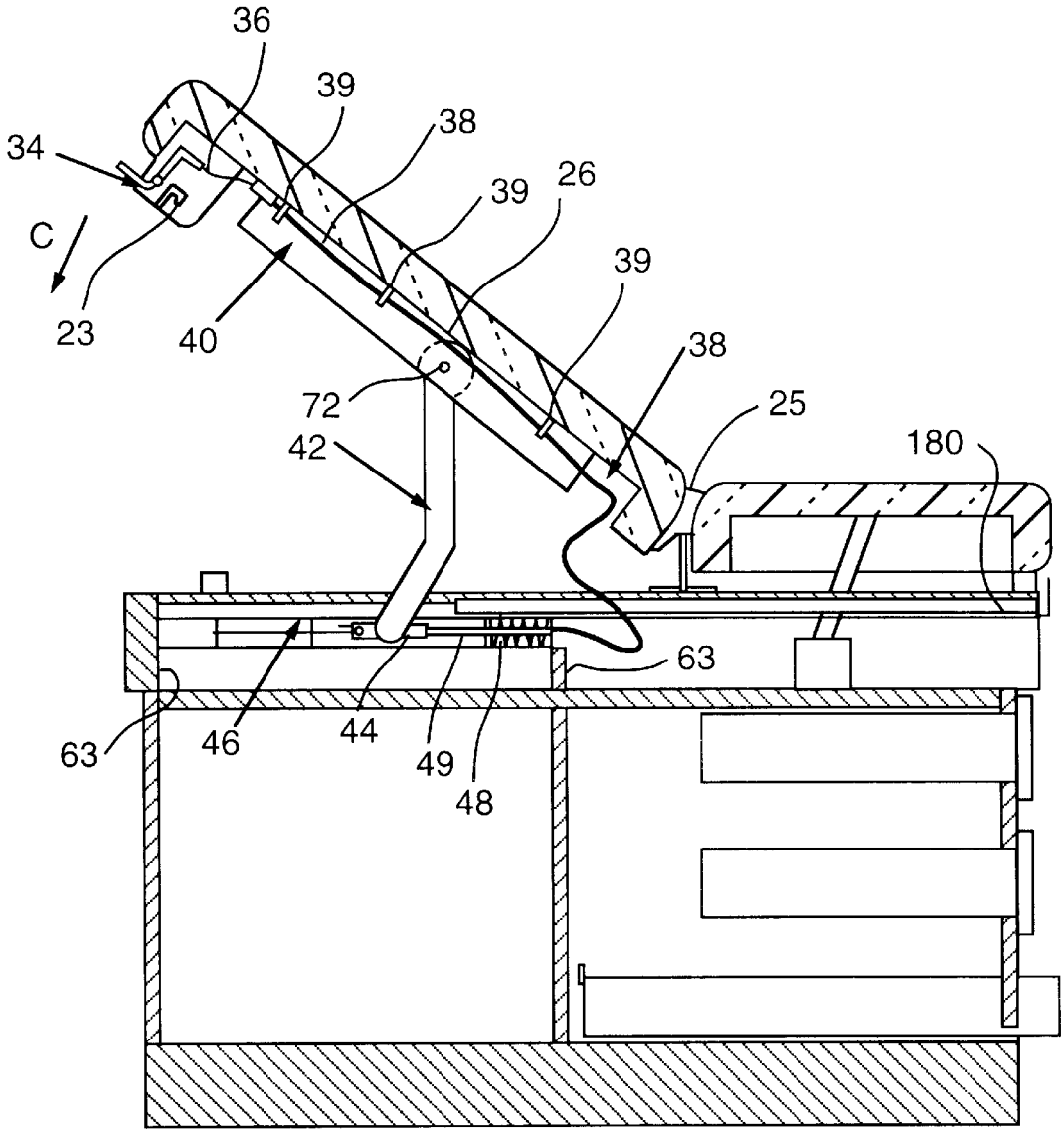
FIG. 5 is a cross sectional view of the medical examination table taken along line 5—5 in FIG. 4 which illustrates the support apparatus of the present invention.

FIG. 5 is a cross sectional view of the medical examination table 10 taken along line 5—5 in FIG. 4 and illustrates the support apparatus of the present invention. The support apparatus substantially comprises a handle 34, a cable 36, a cable conduit 38, a channel runner 40, an arm 42, a containment box 44, a biasing member 46, a shaft 49 and a lock mechanism 48.

Figure 6:
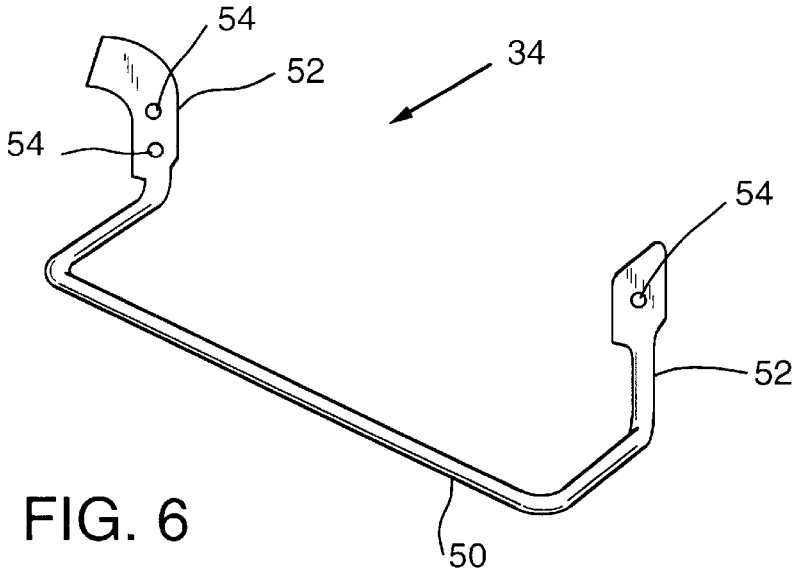
FIG. 6 is a perspective view of the handle of the support apparatus of the present invention shown in FIG. 5.

FIG. 6 is a perspective view of the handle 34 of the support apparatus of the present invention shown in FIG. 5. The handle 34 extends across and is pivotally connected to mounting brackets 23 of the backrest 14. The mounting brackets 23 also support a rod (not shown) that extends across the width of the backrest 14, wherein the rod is a paper roll holder. Specifically, the handle 34 has a U-shaped handle portion 50 with a flange 52 extending from each of the ends of the handle portion 50. Each flange 52 has openings 54 which receive fasteners that pivotally connect the handle 34 to the mounting bracket 23.

The cable 36, shown in FIG. 5, is attached to the handle 34, by a connector and is received within and passes through the cable conduit 38. The cable 34 and cable conduit 38 extend along and are attached to the back surface 26 with several small U-shaped clips 39. The cable 34, cable conduit 38 and connector can be purchased from Cable Manufacturing and Assembly Company, Inc. of Cleveland, Ohio; however, it can be appreciated by one of ordinary skill that the cable can be made from a variety of other materials.

Figure 7:
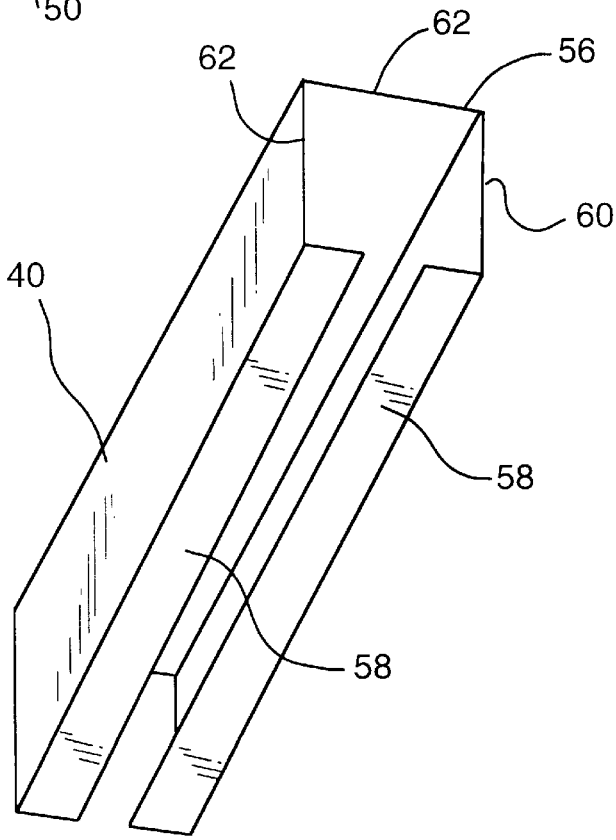
FIG. 7 is a perspective view of the channel runner of the support apparatus of the present invention shown in FIG. 5.

FIG. 7 is a perspective view of the channel runner 40 of the support apparatus of the present invention shown in FIG. 5. The channel runner 40 is also fixedly connected to the back surface 26 of the backrest 14. The channel runner 40 comprises an elongated C-shaped channel 56 with end returns 58 extending from the channel 56. The channel 56 has an intermediate portion 62 with a leg section 60 extending from each end of the intermediate portion 62. Screws (not shown) extending through the intermediate portion 62 along the length thereof fixedly connect the channel runner 40 to the back surface 26. The channel runner 40 is made from twenty (20) gage 304 stainless steel; however, it can be made from various other materials.

Figure 8:
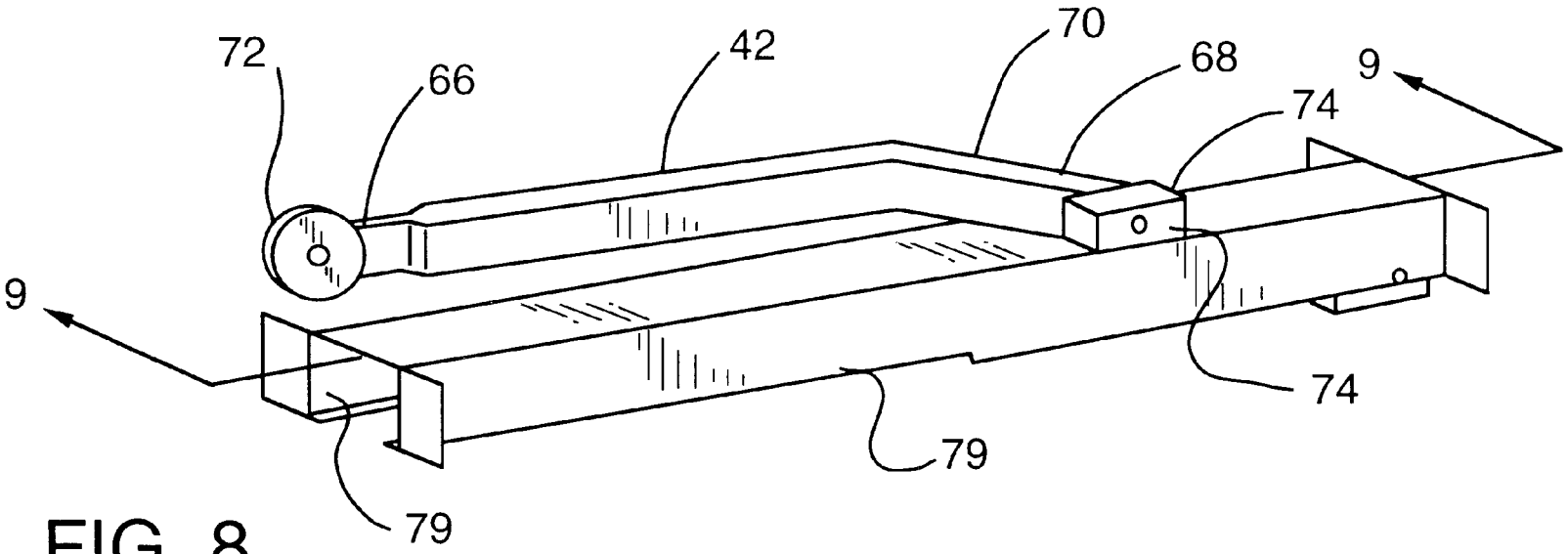
FIG. 8 is a perspective view of the support apparatus of the present invention in the horizontal position.
Figure 9:
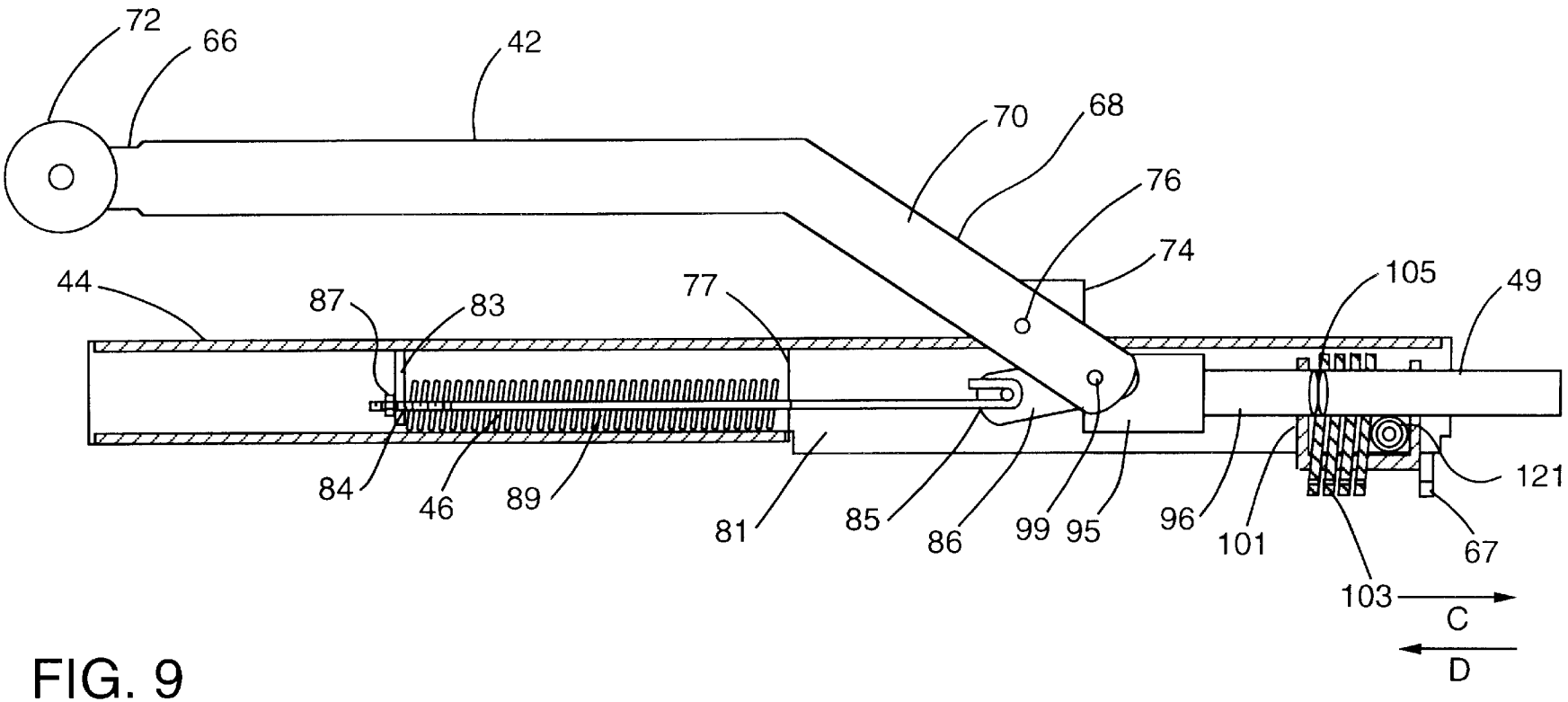
FIG. 9 is a longitudinal cross sectional view of the support apparatus of the present invention taken along line 9—9 shown in FIG. 8.
Figure 10:
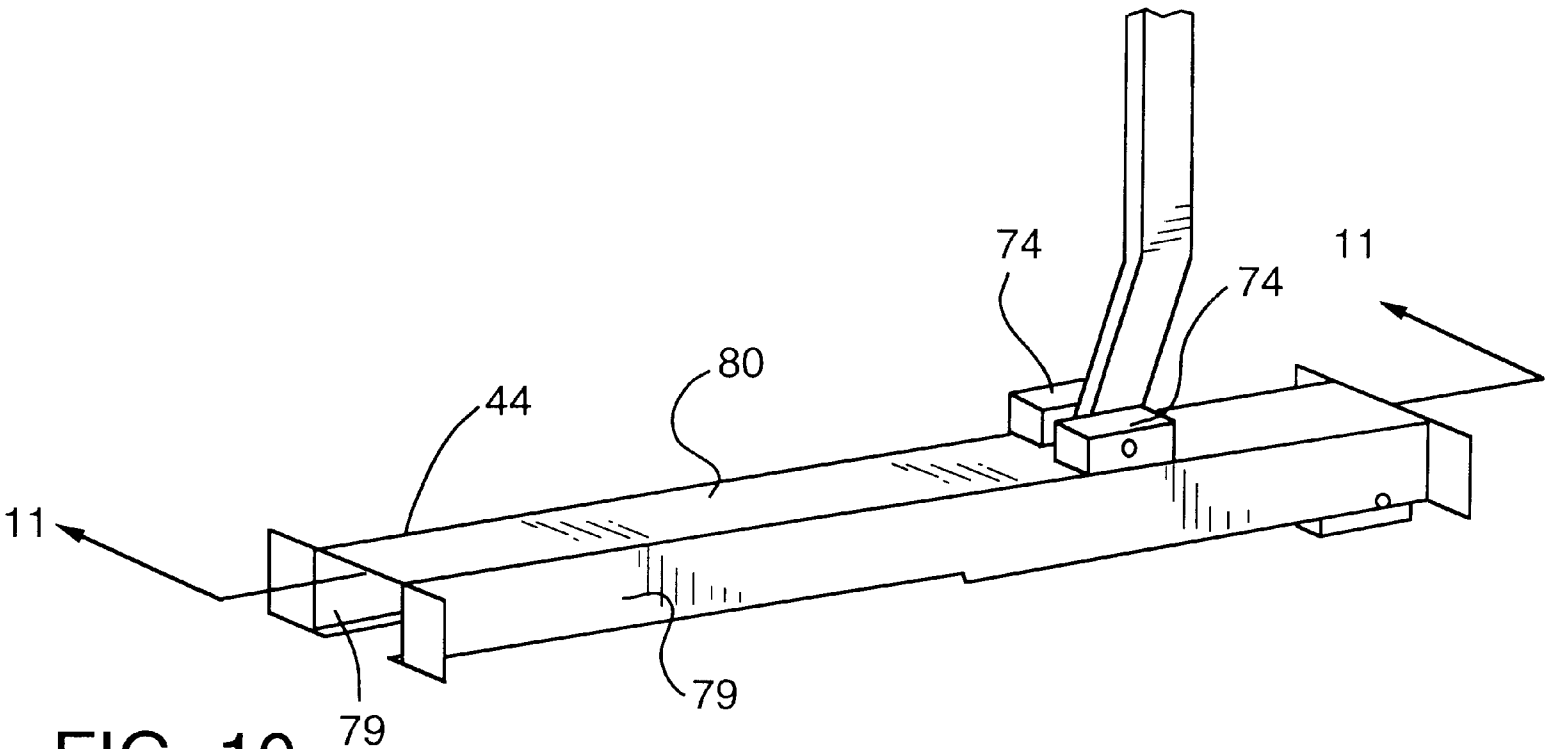
FIG. 10 is a perspective view of the support apparatus of the present invention in the inclined position.
Figure 11:
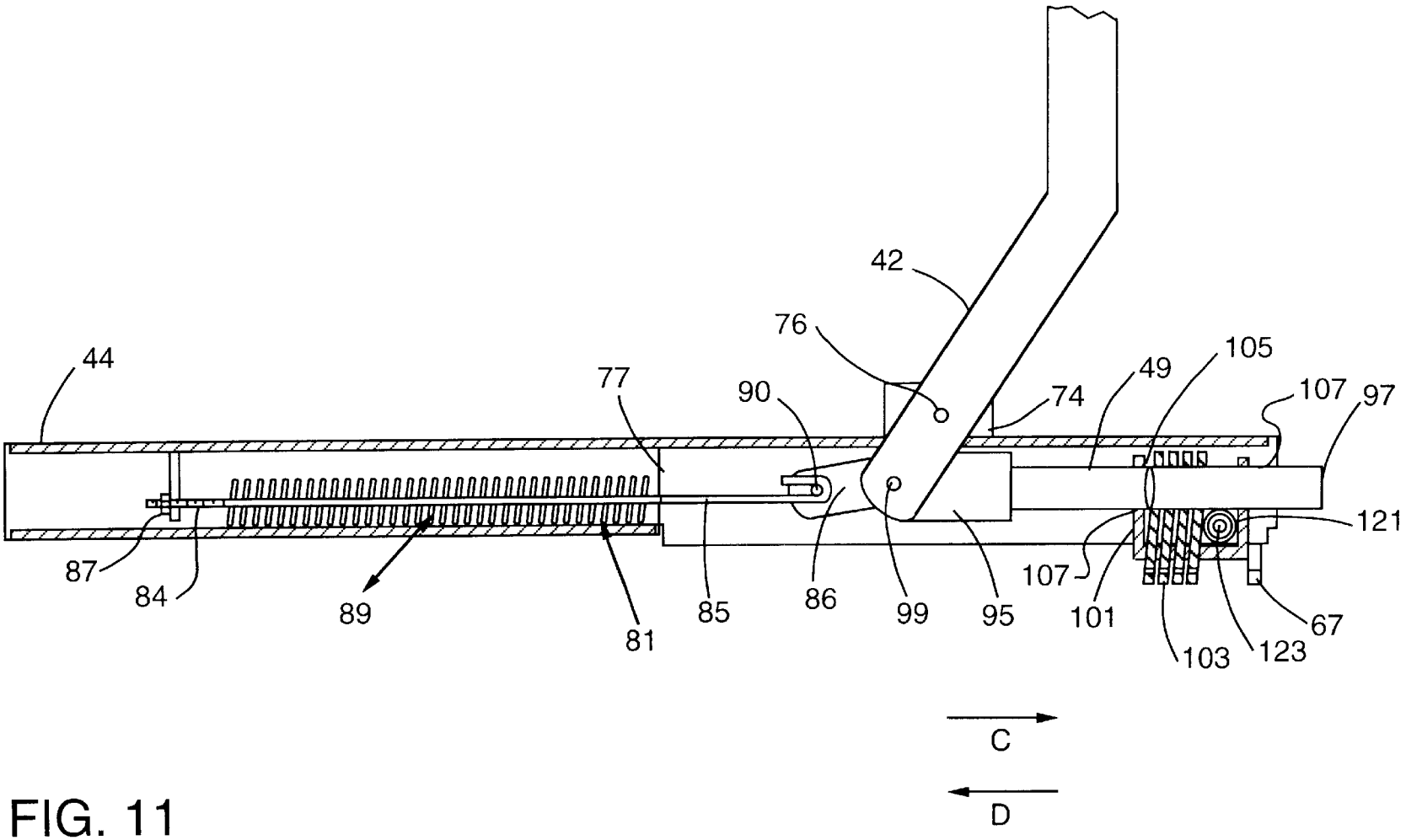
FIG. 11 is a longitudinal cross sectional view of the support apparatus of the present invention taken along line 11—11 shown in FIG. 10.

FIGS. 8 and 9 illustrate the support apparatus of the present invention in the horizontal position. FIGS. 10 and 11 illustrate the support apparatus of the present invention in the inclined position. The arm 42 is an elongated member having a first end 66 and a second end 68 and an angled portion 70. One roller is rotatably connected on either side of the arm 42 at the first end 66. The rollers 72 can be made of nylon or any anti-friction material. The second end 68 of the arm 42 is pivotally connected at 76 to guide blocks 74. The arm is made from one-quarter inch 304 stainless steel plate, but can be made of various other materials such as flat iron.

The containment box 44, shown in FIG. 8, is an elongated tunnel member having a rectangular cross section. The box 44 has two opposing wall members 79, a top surface 80, four flanges 61 extending from the wall members 79 and a divider 77. The divider 77 is fixedly attached within the box 44 by welding. The guide blocks 74 are fixed mounted onto the top surface 80 of the box 44 by welding. The box 44 also defines an aperture 67 throughwhich the cable 36 extends. The containment box 44 is fixedly attached to the top surface 15 of the medical table 10 by fasteners (not shown) extending through and securing together the flanges 61 and partitions 63, shown in FIG. 5. The box 44 is made of cold rolled steel.

The biasing member 46, shown in FIG. 9, comprises a spring 89 mounted around a spring rod 81 and extending between the divider 77 and an aligner member 83. The rod 81 has a threaded end 84 and a hook-shaped end 85. The threaded end 84 extends through a hole in the aligner member 83 and is fixedly attached thereto by a nut 87. The spring 89 can be compressed or relaxed by tightening the nut 87 thereby giving more or less strength, respectively, to the lift of the backrest 14. The spring 89 can be compressed or relaxed by tightening the nut 87. The spring is made of music wire and exhibits approximately ninety-two pounds per inch (92 lbs./in).

A stabilizing bracket 86 is pivotally attached to the arm second end 68 using a pin 99 and rigidly attached to the hook-shaped end 85 of the rod 81. The hook-shaped end 85 extends around a pin member 90 that extends from the stabilizing bracket 84. The stabilizing bracket is a substantially elongated plate member with curved edges. The stabilizing bracket 86 is made of steel.

The shaft 49 has a first end 96 and a second end 97. A U-joint member 95 is welded to the shaft first end 96 and, thus, is fixedly attached thereto. The U-joint member 95 has two legs 98 that extend on either side of the arm 42. Pin 99 extends through the arm 42 and the legs 98 of the U-joint member 95 as well as through the stabilizing bracket 86 thus, pivotally connecting the arm second end 68 to both the U-joint member 95 and the stabilizing bracket 86.

The lock mechanism 48 comprises a key holder 101, key members 103, a tube 121 and a biasing member 105. The key holder 101 is attached to the containment box 44 by pin member 123 and defines apertures 107 through which the shaft 49 extends and is movable therewithin. The key holder 101 has a substantially square configuration.

Figure 12:
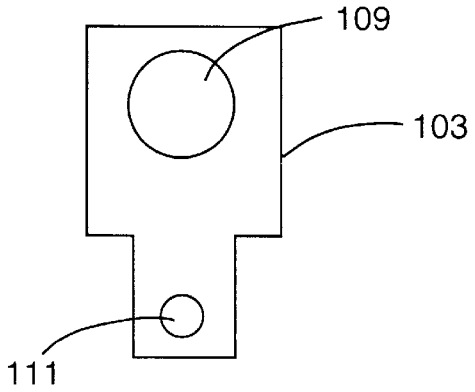
FIG. 12 is a plan view of a key member of the support apparatus of the present invention.

Each key member 103 is a T-shaped body and defines a shaft hole 109 and a cable hole 111. See FIG. 12. The shaft 49 extends through the shaft hole 109 such that the key members 103 are movably received on the shaft 49 and can freely be positioned at an angle with the shaft 49. The cable 36 is movably received within the cable holes 111 of the key members 103. The key members are stamped out of one-eighth inch thick 304 stainless steel.

The tube 121 is positioned within the key holder 101 such that the tube 121 will keep the key members 103 adjacent to one another. The tube 121 is welded to the key holder 101. Although not illustrated, the tube 121 can take any form that would act to keep the key members 103 adjacent to one another.

The biasing member 105 is a spring received around the shaft 49. The spring is made of music wire and exhibits 35.9 lbs./in$^2$ force. The spring abuts the key holder 101. Although not illustrated, one of ordinary skill will appreciate that other types of biasing members can be substituted for the spring.

When the backrest 14 is in the horizontal position (FIGS. 1 and 2) and fully inclined position (FIGS. 3 and 5), the lock mechanism 48 is in a locked position. In the locked position, the biasing member 105 urges the key members 103 in contact with the shaft 49 preventing the shaft 49 from moving. The biasing member 105 exerts a force on the key members 103 such that the key members that define the shaft hole exert a frictional force on the shaft 49 preventing the shaft 49 from moving.

To move the backrest 14 from the horizontal position to the inclined position, the user need only lift the backrest 14 using very little force in order to decrease the weight of the backrest 14 on the arm 42. The handle 34 need not be actuated due to the angular configuration of the key members 103, the shaft 49 is able to move in the D direction thereby allowing the backrest 14 to be elevated. The force of the spring 89 is now the dominant force. The spring 89 will move from its compressed state, shown in FIG. 9, to its relaxed state, shown in FIG. 11. Because the aligner 83 is free to move within the containment box 44, the expansion of the spring 89 will move the aligner 83 in the D direction resulting in the spring rod 81 also being moved in the D direction. The spring rod 81 will move the stabilizing bar 86 in the D direction resulting in the arm second end 68 pivoting at 76 in a clockwise direction thus, moving to the inclined position. As the arm 42 is moving to the inclined position, arm 42 supports the backrest thus, moving the backrest 14 to the inclined position. The rollers 72 roll within the channel runner 44.

To move the backrest 14 from the inclined position to the horizontal position, the user must lift the handle 34 at the handle portion 50 which will unlock the lock mechanism. By lifting the handle 34 the handle portion 50 will also pivot about thirty degrees (30°) resulting in a 0.5 inch stroke and the cable 36 being pulled 0.5 inches in the C direction. See FIG. 5 and FIG. 11. This movement of the cable 36 will cause the key members 103 at the cable holes 111 to also move in the C direction and the key members 103 will compress the biasing member 105 and become disengaged from the shaft 49. The shaft 49 will then be able to move. The force applied to the backrest by the patient or another person will then force the arm 42 and thus, the backrest 14 into the horizontal position.

Figure 13:
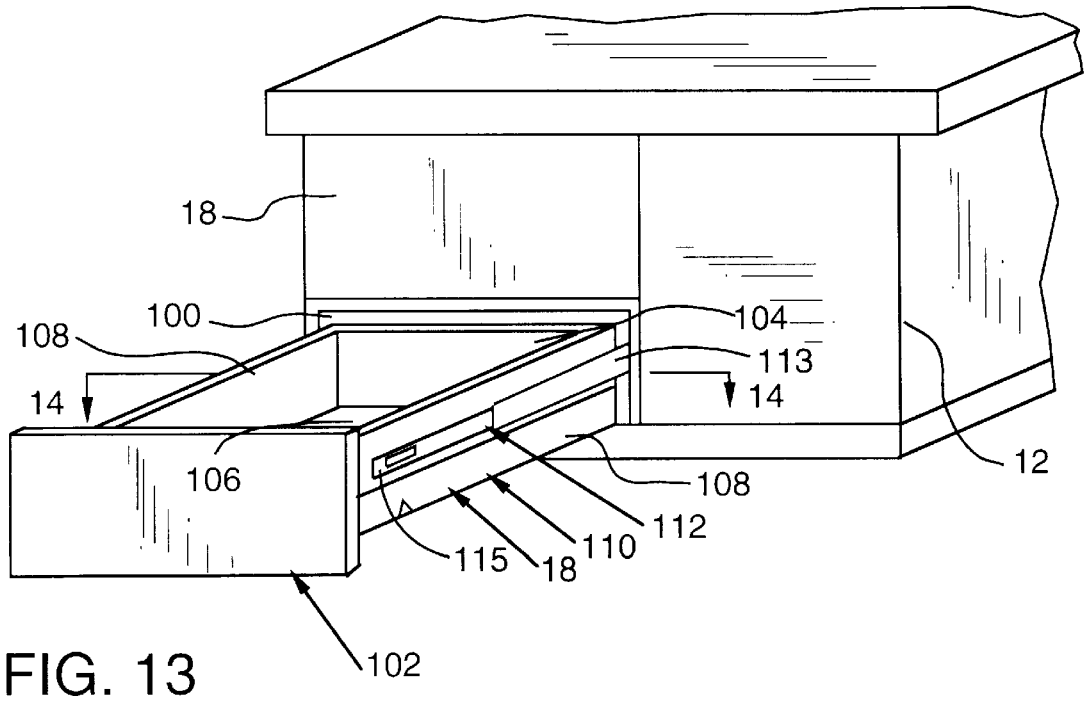
FIG. 13 is a perspective view of a self-aligning drawer of the medical examination table of the present invention, shown in FIG. 1, wherein the drawer is in the open position.

FIG. 13 is a perspective view of a portion of the medical examination table 10 of the present invention having multiple self-aligning drawers 18, wherein one of the drawers 18 is in the open position. The drawers 18 are slideably received in openings 100 of the cabinet 12. Each of the drawers 18 comprises a front panel 102, a back panel 104, a bottom panel 106, two side panels 108 and a resilient extension 110 connected to each of the side panels 108. A slide member 112 is slideably attached to each of the resilient extensions 110 and fixedly attached to the cabinet 12 within the opening 100.

The front panel 102, the back panel 104, the bottom panel 106 and the two side panels 108 form a box structure. The side panels 108 and the bottom panel 106 form one unitary structure. The front panel 102 and the back panel 106 are connected to this unitary structure by welding. The bottom panel 106 and the side panels 108 are manufactured of, for example, A526 galvannealed steel of twenty-four (24) gage. The front and back panels 102 and 104 are preferably manufactured from A526 galvannealed steel of twenty (20) gage. One of ordinary skill will appreciate that other materials can be used to manufacture the drawer 18 such as various other metals or composites.

The slide member 112 enables the drawer 18 to slide smoothly within the opening 100. The slide member 112 is an elongated member having a first track member 113, a second track member 115 and ball bearings (not shown) positioned between the first track member 113 and the second track member 115. The ball bearings allow the first track member 113 and the second track member 115 to slide relative to one another. The first track member 113 is fixedly attached on the interior of the cabinet 12 within the opening 100 using any conventional fastener. The second track member 115 is fixedly attached to the resilient extension 110 by a bayonet connection (not shown). The slide member 112 can be any conventional drawer slide such as drawer slide model No. 8600 purchased from Knape and Vogt of Grand Rapids, Mich.

Figure 14:
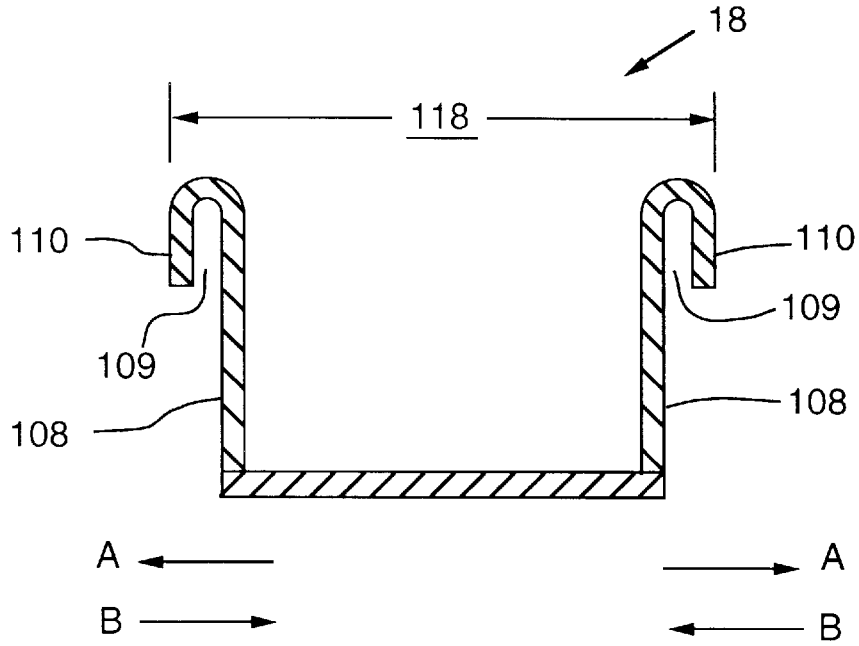
FIG. 14 is a cross sectional view of the self-aligning drawer shown in FIG. 13 taken along line 14—14, wherein the slide member is eliminated.

FIG. 14 is a cross sectional view of the self-aligning drawer 18 shown in FIG. 13 taken along line 14—14, wherein the slide members 112 are eliminated for purposes of clarity. As can be seen in FIG. 14, the resilient extensions 110 are connected to the side panels 108 and form a unitary body therewith. However, the resilient members 110 can be a separate component of the drawer 18. The resilient extensions 110 extend from the side panels 108 and bend back toward the bottom panel 106 to form a U-shape configuration with the side panels 108 and define gap 109. The resilient extensions 110, like the side panels 108 are manufactured from, for example, A526 galvannealed steel of twenty-four (24) gage. However, one of ordinary skill will appreciate that the resilient extensions 110 can be made from many other materials taking into consideration its intended use such as various metals or composites.

When the drawer 18 is mounted within the openings 100 of the cabinet 12, the resilient extensions 110 can deform either away from the side panels 108 (i.e., in direction A), which increases the width of the drawer 18 or towards the side panels 108 (i.e., in direction B), which decreases the width of the drawers. The resilient extensions 110 are generally able to deform up to approximately 0.125 inches in either the A or B direction, thus, effectively increasing or decreasing the overall width 118 of the drawer 18. The resilient extensions 110 of the drawer 18, shown in FIG. 14, are in an undeformed state. If the width of the opening 100 is larger than the overall width 118 of the drawer 18 in its undeformed state, the resilient extensions 110 can be deformed such that the overall width 118 of the drawer 18 can be increased to correspond to the width of the opening 100. Furthermore, if the width of the opening 100 is smaller than the overall width 118 of the drawer 18 in its undeformed state, the resilient extensions 110 can be deformed such that the overall width 118 can be decreased to fit within the opening 100. The ability of the resilient extensions 110 to deform and fit within multiple sized openings 100, enables the drawers 18 to be manufactured with lower tolerances than were previously necessary and also enables the drawers 18 of the medical table 10 to be interchangeably mounted within various sized openings. Furthermore, the drawer 18 construction of the present invention exhibits more flexibility and strength than conventional drawer configurations resulting from the slide member 112 being substituted for ball bearings that are conventionally mounted within the drawer 18.

Figure 15:
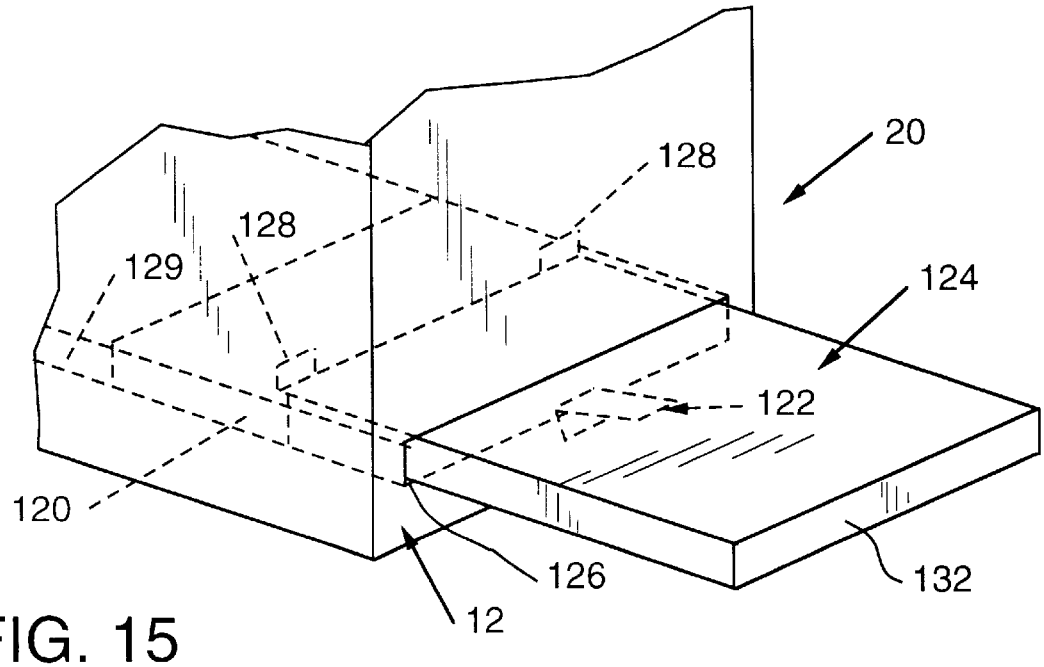
FIG. 15 is a perspective view of a portion of the medical examination table of the present invention, shown in FIG. 1, illustrating a retractable footstep thereof, wherein the runner and the latch of the retractable footstep are illustrated in hidden lines.

FIG. 15 is a perspective view of a portion of the medical examination table 10 of the present invention shown in FIG. 1 illustrating a retractable footstep 20 thereof, wherein a runner 120 and a latch 122 of the retractable footstep are illustrated in hidden lines. The retractable footstep 20 comprises a platform 124 and a runner 120. The runner 120 is welded to a ledge 129 within the cabinet 12. The retractable footstep 20 is slideably received within a cavity 126 of the cabinet 12 positioned approximately five (5) inches from the floor.

Figure 16:
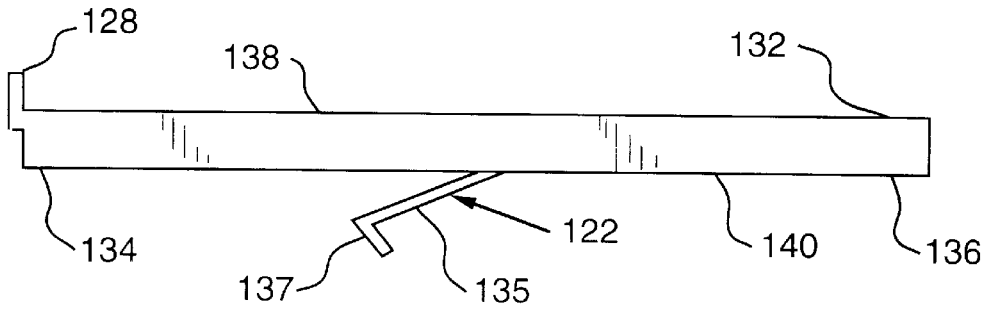
FIG. 16 is a side view of the platform of the retractable footstep of the present invention shown in FIG. 15 that also illustrates the tabs and the latch of the footstep.

FIG. 16 is a side view of the retractable footstep 20 of the present invention shown in FIG. 15 that illustrates tabs 128 and the latch 122 of the footstep 20. The footstep 20 comprises a platform 132 having a first end 134, a second end 136, a top side 138 and an underside 140. The platform 132 is slideably received within the runner 120. The platform 132 is manufactured from mild steel and is approximately 24 inches in length by 17 inches wide by 2.5 inches in height. The platform 132 can include a stainless steel rim (not shown) that covers the edges of platform 132 and is for decorative purposes.

Tabs 128 are fixedly attached to the first end 134 by spot welding and extend substantially perpendicular from the top side 138 of the platform 132. Like the platform 132, the tabs 128 are preferably manufactured of 304 stainless steel. It is important that the tabs 128 be manufactured of a material that is resistant to wear and is flexible such as stainless steel. As the platform 132 is moved from a retracted position to an extended position, the tabs 128 contact the runner 120. Thus, the tabs 128 are susceptible to wear from this contact.

The latch 122 extends from and is pivotally connected to the underside 140 of the platform 132. A weld attaches the latch 122 to the underside 140 of the platform 132. The latch has a first leg 135 and a second leg 137, wherein the two legs 135 and 137 are positioned at an angle relative to one another and form a unitary member. The latch 122 may be made of A526 galvannealed steel of eighteen (18) gage.

Figure 17:
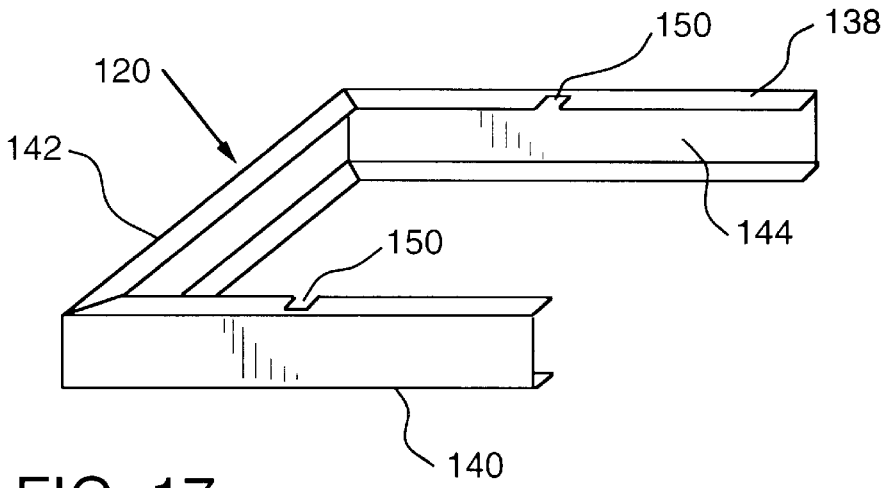
FIG. 17 is a perspective view of the runner of the retractable footstep of the present invention shown in FIG. 15.

FIG. 17 is a perspective view of the runner 120 of the retractable footstep 20 of the present invention shown in FIG. 15. The runner 120 is received within cavity 126 and fixedly attached to the ledge 129 of the cabinet 12 by welding. The runner 120 is a substantially a U-shaped member having a first leg 138, a second leg 140 and an intermediate portion 142. A channel 144 runs along the interior surface of the first leg 138, the second leg 140 and the intermediate portion 142. The channel 144 has an upper leg 146 and a lower leg 148. The upper leg 146 of the channel 144 defines slots 150 in the first and second legs 138 and 140 of the runner 120. The runner 120 is manufactured of galvannealed steel of fourteen (14) gage. However, one of ordinary skill will appreciate that the runner 120 as well as the platform 132 and any components thereof can be manufactured from other materials than those specified herein by considering what the intended use of the components.

In its retracted position, the second end 136 of the platform 132 extends a short distance from the front surface 19 of the cabinet 12, as shown in FIGS. 1 and 3. The footstep 20 moves from its retracted position to an extended position, shown in FIG. 15, by pulling the platform 132 out of the cavity 126. As the platform 132 is pulled out of the cavity 126, the weight of the platform 132 causes the platform 132 to dip down at its second end 136 where it is not supported and also causes the first end 134 of the platform 132 to tilt upward such that the tabs 128 will contact the runner until they engage the slots 150 at which point the tabs 128 extend substantially perpendicularly from the top side of the platform 132. The distance that the platform 132 can extend from the front surface 19 is limited by the latch 122 and the tabs 128. At its fully extended position, the tabs 122 engage the slots 150 of the runner 120 and the latch 122 engages the cabinet 12 thus, preventing the platform 132 from extending further than its fully extended position and becoming disengaged from the cabinet 12. The platform 132 can extend a maximum of thirteen (13) inches from the cabinet front surface 19.

Figure 18:
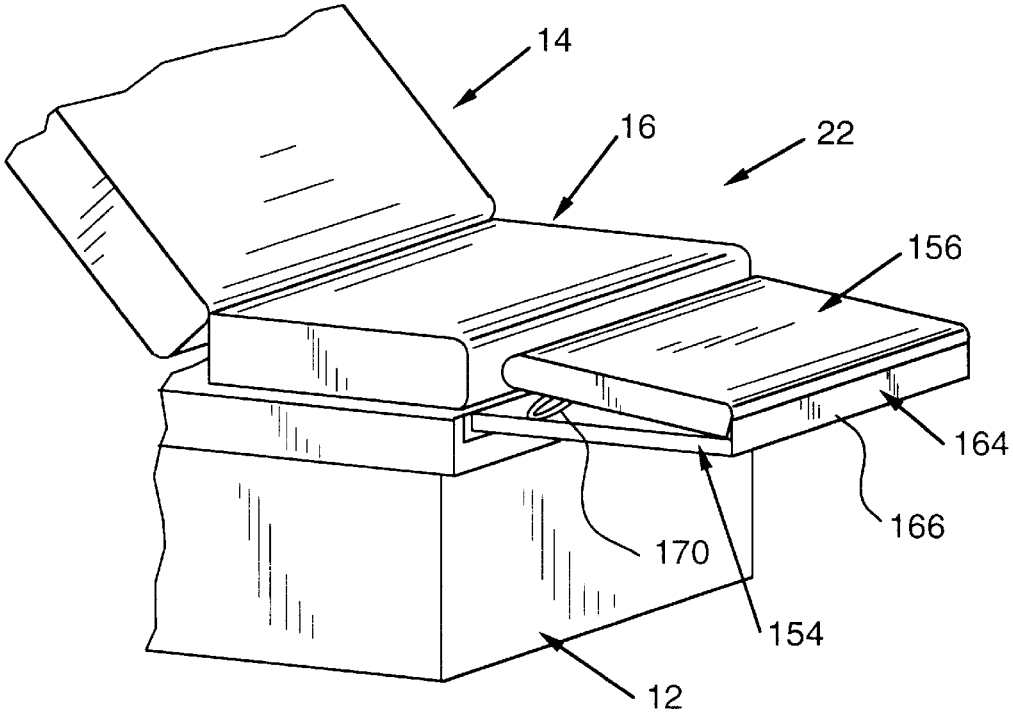
FIG. 18 is a partial perspective view of the medical examination table of the present invention shown in FIG. 1 that illustrates a leg rest thereof in an extended position.
Figure 19:
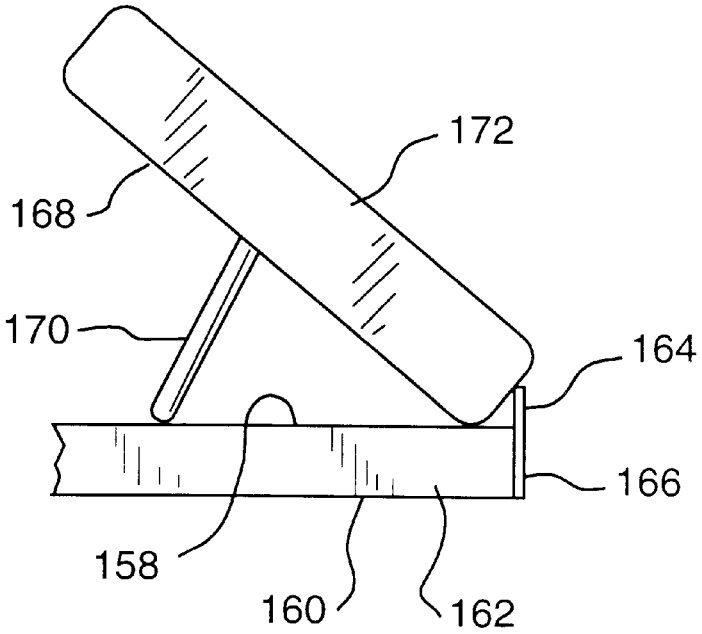
FIG. 19 is a side view of the leg rest shown in FIG. 18.
Figure 20:
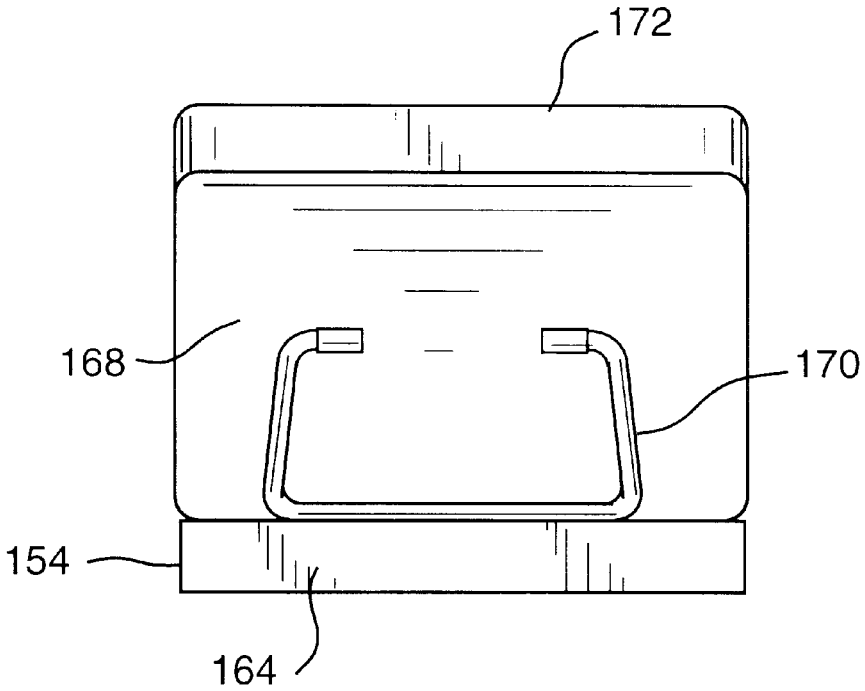
FIG. 20 is a back view of the leg rest shown in FIG. 18.

FIG. 18 is a partial perspective view of the medical examination table of the present invention shown in FIG. 1 that illustrates a leg rest thereof. FIG. 19 is a side view of the leg rest shown in FIG. 18 and FIG. 20 is a back view of the leg rest shown in FIG. 18. FIGS. 18 through FIG. 20 illustrate the pad 156 in an inclined position. The leg rest 22 comprises a shelf member 154 and a pad 156 that rests on the shelf member 154. The leg rest 22 is retractable within a second cavity 158 of the table 10. The leg rest 22 can be extended from its retracted position, shown in FIGS. 1 and 3, to an extended position, shown in FIG. 18.

The shelf member 154 has a top surface 158, a bottom surface 160, two sides 162 and a lip 164. The shelf member 154 further has a first end 166 and a second end (not shown), which extends within the second cavity and wherein the lip 164 is positioned at the first end 166 along the edge thereof. The shelf member 154 is slideably received by the runners 180. See FIGS. 2 and 5. The runners 180 extend two-thirds of the length of the cabinet 12.

The shelf member 154 is formed from one elongated piece of 304 stainless steel of twenty-two (22) gage. First, a distance equal to the length of the bottom surface 160 is measured from an end of the elongated piece of stainless steel. Then the elongated piece of stainless steel is bent at a right angle at the measured distance to form the lip 164. The piece of steel is then bent 180 degrees such the lip 164 has a double thickness. The piece of steel then is bent at a right angle to form the top surface 158 of the shelf member 154. The sides of the piece of steel forming the top surface 158 are then bent at right angles to form the sides 162 of the shelf member 154. This results in the shelf member 154 having no seams or open areas where fluids can penetrate thus, preventing the material from corroding. Furthermore, stainless steel is chosen because it is resistant to corrosion.

The pad 156 has a rigid bottom surface 168, a prop rod 170, tubular connectors 173 and a stuffed body 172 on which the patient's legs rest. The stuffed body 172 comprises stuffing (not shown) such as plastic foam covered with a vinyl material. The bottom surface 168 is made of wood. The bottom surface 168 is attached to the stuffed body 172 by any fastener such as adhesive or screws.

The tubular connectors 173 are secured to the bottom surface 168 by screws. The prop rod 170 fits within and is rotatably attached to the tubular connectors 173. The prop rod 170 is a 0.25 diameter rod having a U-shaped configuration. In its inclined position, the prop rod 170 forms an angle with the bottom surface 168 such that the stuffed body 172 substantially meets the seat portion 16 and the legs of the patient are solidly supported. See FIG. 18. To collapse the pad 156 from the inclined position to the horizontal position, the prop rod 170 is rotated within the tubular connectors 173 towards the bottom surface such that the prop rod 173 is substantially parallel to the bottom surface.

Those of ordinary skill in the art will recognize, however, that many modifications and variations of the present invention may be implemented without departing from the spirit and scope of the present invention. The foregoing description and the following claims are intended to cover such modifications and variations.

What we claim is:

1. A device for supporting a structure in a horizontal position and an inclined position, said device comprising:

an arm having a first end portion and a second end portion, wherein said first end is pivotally attachable to the structure and said second end portion is connected to a stationary body such that the arm can pivot from one position wherein the structure is in a horizontal position to another position wherein the structure is in an inclined position;

a biasing member connected to said arm second end portion, wherein said biasing member urges said arm into said another position;

a shaft having a first end and a second end, said shaft first end pivotally connected to said arm second end portion; and a lock mechanism movably connected to said shaft second end between a locked position and an unlocked position, wherein when said lock mechanism is in said locked position, said lock mechanism prevents movement of said shaft.

2. The device of claim 1, further comprising at least one antifriction member connected to said arm first end portion and is connectable with the structure.

3. The device of claim 1, further comprising a housing fixedly connected to said stationary body, and wherein said biasing member is a spring mounted on a rod connected to said arm and having a wall member fixedly connected thereto, said spring contacts and extends between a portion of said housing and said wall member which is movably positioned with respect to said housing portion such that movement of said arm from said horizontal position to said inclined position causes said wall member to move away from said housing portion and thus, relaxes said spring.

4. The device of claim 3, further comprising a bracket having a first end and a second end, wherein said bracket first end is fixedly connected to said arm second end portion and said bracket second end is connected to said rod.

5. The device of claim 1, further comprising a second biasing member connected to said shaft and that biases said lock mechanism into frictional engagement with said shaft.

6. The device of claim 5, further comprising a release for said lock mechanism, wherein when said release is activated, said release disengages said lock mechanism from said shaft.

7. The device of claim 5, wherein said second biasing member is a spring having coils that extend around said shaft.

8. The device of claim 1, wherein said lock mechanism comprises a plurality of key members each defining a key hole through which said shaft extends.

9. The device of claim 6, wherein said release comprises a cable which engages said plurality of key members such that when said release is activated said cable aligns said plurality of key members such that said shaft extends through each of said key holes and does not contact said plurality of key members.

10. The device of claim 9, wherein each of said plurality of key members further define an aperture through which said cable extends such that when said cable is activated by pulling said cable taut said plurality of key members are moved from an inclined position where they frictionally engage said shaft to a substantially vertical position where said shaft extends through said key holes without contacts said plurality of key members.

11. The device of claim 1, wherein said stationary body is a plurality of guide blocks, wherein said arm is between said plurality of guide blocks.

12. The device of claim 1, further comprising a U-shaped member extending between and fixedly connected to both said arm second end portion and said shaft first end.

13. A support apparatus for a backrest of a medical examination table, said support apparatus comprising:

an arm having a first end portion and a second end portion, said first end portion supports the backrest, said second end portion is connectable to a top surface of the examination table such that the arm can pivot from a horizontal position to an inclined position relative to the top surface while also moving the backrest from a horizontal position to an inclined position;

a biasing member fixedly connected to said arm second end portion, wherein said biasing member urges said arm into said inclined position;

a shaft having a first end and a second end, said shaft first end fixedly connected to said arm second end portion; and a lock mechanism connected to said shaft second end between a locked position and an unlocked position, wherein when said lock mechanism is in said locked position, said lock mechanism frictionally engages said shaft thereby preventing movement of said arm.

14. The support apparatus of claim 13, wherein said arm has a handle portion.

15. The support apparatus of claim 13, further comprising at least one roller rotatably connected to said arm first end portion such that said roller is engageble with the backrest when said arm moves from said horizontal position to said inclined position.

16. The support apparatus of claim 13, further comprising a box-shaped housing connectable to the top surface of the examination table and having a divider and a plurality of guide blocks, and wherein said biasing member comprises a spring mounted on a rod wherein said rod has a first end and a second hook end, said rod passes through said divider, said first end of said rod is fixedly connected to a wall member that moves freely within said housing and said second hook end of said rod is connected to said arm second end portion such that said spring extends between said divider and said wall member and the length of said spring is defined by the distance between said divider and said wall member such that when said arm moves from said inclined position to said horizontal position said spring is compressed.

17. The support apparatus of claim 16, wherein said arm is pivotally supported by and extends between said plurality of guide blocks.

18. The support apparatus of claim 13, further comprising a release for said lock mechanism.

19. The support apparatus of claim 18, wherein said lock mechanism comprises a plurality of key members each defining a key hole through which said shaft extends and each further defining an aperture, said lock mechanism further comprising a spring attached to said shaft and biasing said plurality of key members in said locked position, wherein said plurality of key members are in frictional engagement with said shaft, and wherein said release comprises a cable and a cable holder, wherein said cable extends through said cable holder and said apertures of said plurality of key members such that when the cable is pulled taut, said plurality of key members are separated from said shaft and thus the lock mechanism is in the unlocked position.

20. The support apparatus of claim 19, further comprising a latch connectable to the backrest and said cable.

21. A support apparatus for a backrest of a medical examination table, said support apparatus comprising:

support means for supporting the backrest, said support means is pivotally connectable to the table such that the support means moves the backrest from a horizontal position to an inclined position and back to said horizontal position;

biasing means for urging said support means into said inclined position, said biasing means fixedly connected to said support means;

lock means for holding said support means in one of said horizontal position and said inclined position, said lock means connected to said support means; and release means for disengaging said lock means.

* * * * *

UNITED STATES PATENT AND TRADEMARK OFFICE

CERTIFICATE OF CORRECTION

PATENT NO. : 6,209,463 B1
DATED : April 3, 2001
INVENTOR(S) : Koharchik et al.

It is certified that error appears in the above-identified patent and that said Letters Patent is hereby corrected as shown below:

Column 2,
Line 7, delete "is" and substitute therefor -- are --;

Column 4,
Line 37, delete "form" and substitute therefor -- from --;

Column 9,
Line 17, delete the first occurrence of "a";
Line 29, delete "what";

Column 10,
Line 10, after "such" insert -- that --;
Line 37, delete "173" and substitute therefor -- 170 --;

Column 11,
Line 40, delete "contacts" and substitute therefor -- contacting --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*